United States Patent [19]

Ideue et al.

[11] Patent Number: 4,671,017

[45] Date of Patent: Jun. 9, 1987

[54] METHOD AND APPARATUS FOR GRINDING A ROTARY BODY

[75] Inventors: Kazuo Ideue; Masashi Oya; Kanji Hayashi; Tsuneo Egawa; Hiroaki Shimazutsu; Junichi Ibushi; Kunio Yamamoto; Kanehisa Miyaguchi; Tamenari Doho, all of Hiroshima, Japan

[73] Assignee: Mitsubishi Jukogyo Kabushiki Kaisha, Tokyo, Japan

[21] Appl. No.: 817,482

[22] Filed: Jan. 9, 1986

[30] Foreign Application Priority Data

Jan. 11, 1985 [JP] Japan ..... 60-2181

[51] Int. Cl.[4] ..... B24B 5/04; B24B 1/00

[52] U.S. Cl. ..... 51/49; 51/289 R

[58] Field of Search ..... 51/49, 289, 326, 327

[56] References Cited

U.S. PATENT DOCUMENTS 504,566 9/1893 Davidson ..... 51/49

2,869,295 1/1959 Naumann ..... 51/289 R

FOREIGN PATENT DOCUMENTS 0174789 5/1953 Austria ..... 51/289 R

*Primary Examiner*—Frederick R. Schmidt

*Assistant Examiner*—Robert A. Rose

*Attorney, Agent, or Firm*—Wenderoth, Lind & Ponack

[57] ABSTRACT

A method and apparatus for grinding a roll in a rolling mill on an on-line grinding basis, are improved in that a freely rotatable grinding body such and is a grindstone is pressed against a surface of the roll to be ground as directed in the direction making a predetermined angle with respect to the axis of the roll. The roll is rotated so that the surface of the roll may be ground by a relative slip between the grinding body and the roll caused by their different circumferential velocities.

4 Claims, 9 Drawing Figures

METHOD AND APPARATUS FOR GRINDING A ROTARY BODY

BACKGROUND OF THE INVENTION

1. Field of the Invention

The present invention relates to a method and an apparatus for grinding a rotary body, and more particularly to such method and apparatus which can be favorably employed for on-line roll grinding, that is, for grinding a roll in a state of being assembled within a rolling stand in a rolling mill such as a hot rolling mill or the like.

2. Description of the Prior Art

In a rolling mill for rolling a metal sheet, a work is remarkably locally worn roll at the portion contacting the sheet to be rolled. Therefore, in order to roll metal sheets, the so-called "schedule rolling" in which a sequence of rolling operations for the metal sheets is chosen in such a manner that the rolling operations are sequentially shifted from rolling of wide metal sheets to rolling of narrow metal sheets. The work roll is replaced at a necessary time, and after the worn roll has been ground externally of the rolling mill, it was again assembled within the rolling mill to be used for rolling operations.

However, the above-mentioned method of grinding a roll on an off-line basis while carrying out the schedule rolling, had shortcomings in that a production efficiency was degraded due to the restructured sequence of rolling operations, and moreover, that an extensive place for the metal sheets to be rolled was necessitated because metal sheets having different widths had to be stored so as to conform to the sequence of rolling operations. Furthermore, the frequency of replacing the work roll was so high that a great amount of labor was necessitated, and also enhancement of an availability factor for the installation was prevented. Hence, development of an on-line roll grinding apparatus in which a surface of a roll is ground into a desired roll profile while the roll is kept assembled within a rolling stand, a period between roll replacements is prolonged, and rolling operations that are not restricted in their sequence by width of metal sheets has been made possible.

Among the heretofore known representative ones of the above-referred on-line roll grinding apparatuses, apparatuses of the types shown in FIGS. 8 and 9 are well known. More particularly, in the apparatus shown in FIG. 8, while a work roll a is being rotated in the direction of arrow, a grinding body b not rotating such as, for instance, a rectangular-column-shaped grindstone is pressed against the surface of a work roll a in the direction at right angles to the axis of the roll a, and grinding is effected while the grinding body b is moved in the direction of the axis of the roll, that is, in the direction perpendicular to the sheet of the drawing. In the apparatus shown in FIG. 9, a grinding body c such as a disc-shaped grindstone, which is rotating about an axis that is in parallel to the axis of a rotating work roll a at a different circumferential velocity from that of the work roll a, is pressed against the rotating work roll a, and grinding is effected while the grinding body c is moved in the direction of the axis of the roll a.

Among the above-described on-line roll grinding apparatuses in the prior art, in the case of the apparatus shown in FIG. 8, while the structure is simple because of the absence of a rotary driving device for the grinding body b such as a grindstone, there is a shortcoming in that since a grinding surface of the grinding body b is always presented as the grinding surface, clogging would occur on the grinding surface, hence a grinding capability is lowered in a short period of time, and moreover, corner portions of the grinding body are liable to be broken.

On the other hand, in the case of the apparatus shown in FIG. 9, while there is a merit in that since the grinding body c is rotating, clogging of the grinding surface can be prevented and thereby a grinding capability can be maintained, there is a shortcoming in that as a rotary driving device not shown for grinding body c is necessitated, the structure becomes complex and a greater installation expense is reliable. Moreover, since the rotary shaft of the grinding body c must be directed parallel to the axis of the roll, it is difficult to array a large number of grinding bodies along the longitudinal direction of the roll.

SUMMARY OF THE INVENTION

It is therefore one object of the present invention to provide an on-line grinding method and apparatus, in which the above-described shortcomings of the grinding apparatuses in the prior art are obviated, a rotary driving device for a grinding body is not necessitated, the apparatus is simple in structure and of low cost, and the grinding capability is excellent.

The method and apparatus for grinding a roll in a rolling mill according to the present invention are characterized in that a freely rotatable grinding body such as a grindstone is pressed against the surface of the roll to be ground as directed in the direction making a predetermined angle with respect to the axis of the roll. The roll is made to rotate so that the surface of the roll may be ground due to the relative slip between the grinding body and the roll caused by their different circumferential velocities. More particularly, according to the present invention, the grinding body such as a grindstone is not associated with a rotary driving device but is made to rotate as a result of rotation of a roll to be ground because it is pressed against the surface of the roll. Due to the fact that the rotary axis of the grinding body is not in parallel to the axis of the roll, relative slip occurs between the different circumferential velocities of the grinding body and the roll to be ground, and thereby grinding of the roll surface can be achieved

BRIEF DESCRIPTION OF THE DRAWINGS

In the accompanying drawings

DESCRIPTION OF THE PREFERRED EMBODIMENTS

Now, the preferred embodiments of the present invention will be described with reference to the accompanying drawings.

Figure 1:
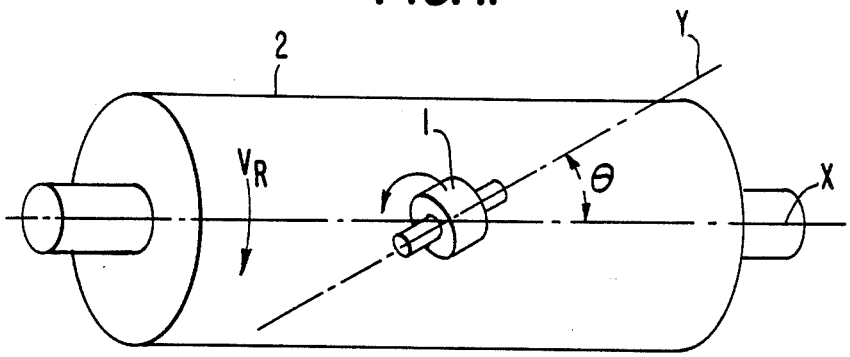
FIG. 1 is a perspective view showing one preferred embodiment of the method according to the present invention.

As seen in FIG. 1, which shows a first preferred embodiment of the present invention, a cylindrical grinding body such as a grindstone (1) is pressed against a circumferential surface of a roll (2) to be ground (work roll). The grindstone (1) is pressed against the surface of the roll (2) to be ground with its rotary axis Y directed in a direction making an angle ($\theta$) with respect to the axis x of the roll (2) to be ground.

Figure 7:
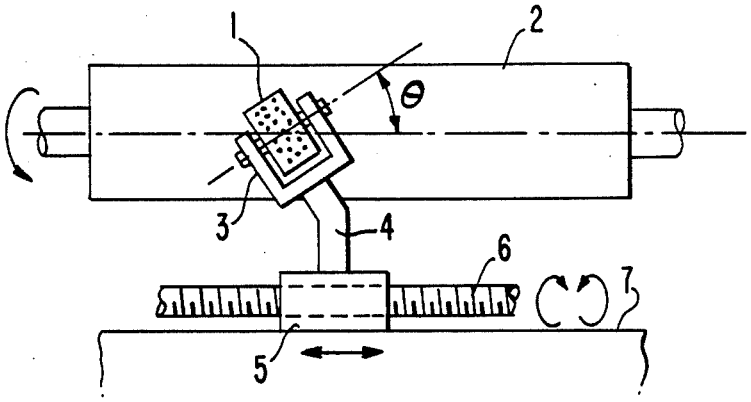
FIG. 7 is a schematic view showing one example of a grinding body support and a feed mechanism therefor.

FIG. 7 shows one example of a grindstone support and a feed mechanism therefor, in which a grindstone (1) is pivotably supported from an inclined bracket (3) so as to be freely rotatable, and the bracket (3) is supported from a support table (5) via a support rod (4). The support table (5) is to mated with a screw rod (6), so that it is moved in the axial direction of the roll (2) along a guide beam (7) mounted between housing members of a rolling mill not shown, as a result of rotation of the screw rod (6).

Figure 2:
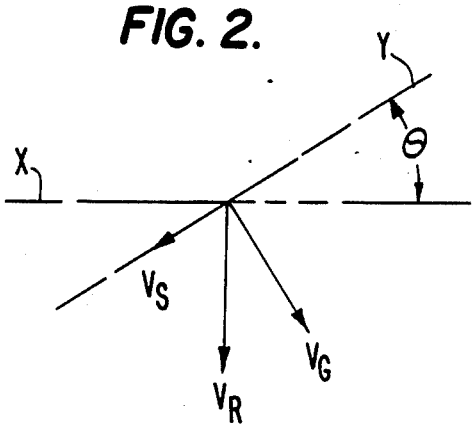
FIG. 2 is a vector diagram illustrating a principle of the present invention.

Due to the above-mentioned construction, if the grindstone (1) is pressed against the surface of the roll (2) to be ground is while the roll (2) to be ground held in the state of being assembled within a rolling stand (in the on-line state) and is rotated at a circumferential velocity $V_R$ (normally the roll (2) is driven into an idling operation by a driving device of the rolling mill), then the grindstone (1) would rotate following the rotation of the roll (2) to be ground. In this case, since the axis X of the roll (2) and the axis Y of the grinding body (1) intersect at an angle $\theta$ therebetween, a circumferential velocity $\vec{V_G}$ of the grinding body (1) becomes equal to a vector component in the direction perpendicular to the axis Y of the circumferential velocity $\vec{V_R}$ of the roll (2), and hence a relative slip $\vec{V_S}$ directed in the direction of the axis Y of the grinding body (1) corresponding to a vector difference $\vec{V_S}=\vec{V_R}-\vec{V_G}$, would arise between the grinding body (1) and the roll (2), as shown in FIG. 2. At this moment, since the grindstone (1) is pivotably supported by the above-mentioned support table (5) so as to be unable to move in the direction of its axis Y, the surface of the roll (2) to be ground would be ground as a result of the above-mentioned relative slip $\vec{V_S}$. As the grindstone (1) can be moved in a direction parallel to the axis X of the roll (2) by means of the above-described grindstone support and feed mechanism, the grinding can be achieved arbitrarily by moving the grindstone (1) to any desired location on the surface of the roll (2) to be ground. It is to be noted that while only one grinding body (1) is illustrated in FIGS. 1 and 7, it is possible to enhance a grinding efficiency by arranging a plurality of similar grinding bodies along the circumferential surface of a roll (2) to be ground in the direction parallel to the axis of the roll (2).

Figure 8:
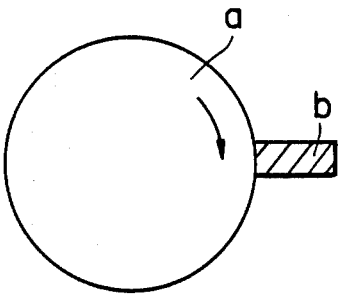
FIGS. 8 and 9 are schematic views showing two different types of rotary body grinding apparatuses in the prior art.
Figure 9:
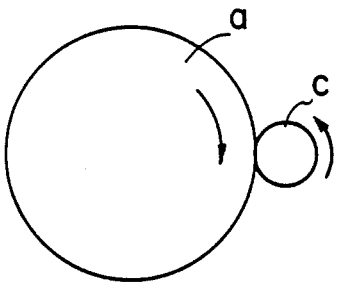

As will be apparent from the above description, according to the present invention, as the grinding body rotates as driven by the roll to be ground, clogging will not occur on the surface of the grinding body as is the case with the prior art method illustrated in FIG. 8, and also a rotary driving device for the grinding body is not necessitated as is the case with the prior art method illustrated in FIG. 9, so that the structure of the apparatus is very simple even including the feed device. Accordingly, the present invention contributes greatly to enhance the efficiency of the grinding operation and reduce installation costs.

Figure 3:
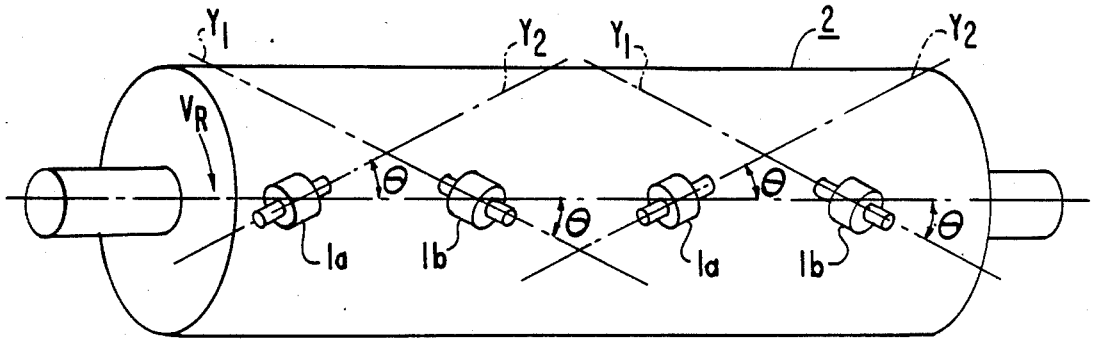
FIG. 3 is a schematic perspective view showing one preferred embodiment of the apparatus for grinding a rotary body according to the present invention.

FIG. 3 shows a second preferred embodiment of the present invention, in which a plurality of grinding bodies such as grindstones (1*a*) and (1*b*) are arranged along a circumferential surface of a body to be ground such as a roll (2) parallel to the axis X of the roll (2), and the rotary axes $Y_1$ and $Y_2$ of the adjacent grindstones (1*a*) and (1*b*), respectively, are inclined in the opposite directions to each other which intersect at an angle $\theta$ with respect to the axis X of the roll (2). With regard to a grindstone support and a feed mechanism therefor, that similar to the support and feed mechanism described above and illustrated in FIG. 7 could be employed.

Figure 4:
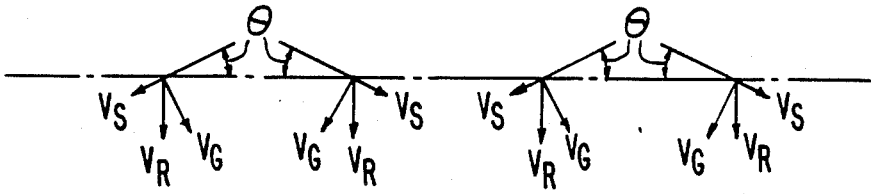
FIG. 4 is a vector diagram illustrating a principle of the operation of the apparatus shown in FIG. 3.
Figure 5:
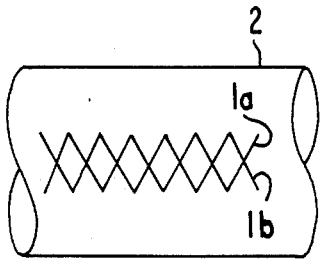
FIG. 5 is a schematic view showing a mode of grinding a roll surface by making use of the apparatus shown in FIG. 3.

As discussed in detail above with reference to FIG. 2, if the grindstones (1*a*) and (1*b*) are pressed against the roll (2) rotating at a circumferential velocity $V_R$, then as seen in FIG. 4, all of the grindstones (1*a*) and (1*b*) would rotate at a circumferential velocity $\vec{V_G}$, and consequently, a relative slip $\vec{V_S}$ would arise at contact points between the surfaces of these grindstones (1*a*) and (1*b*) and the surface of the roll (2). The relative slips $\vec{V_S}$ at the adjacent grindstones (1*a*) and (1*b*) are directed in different directions. Since the surface of the roll (2) is ground in the direction of the relative slips $\vec{V_S}$, as shown by the schematic view in FIG. 5, grinding by the grindstones (1*a*) is effected in the right-upward direction, while grinding by the grindstones (1*b*) is effected in the left-upward direction. In this way grinding is effected in two directions without being limited to one direction, hence an averaged grinding can be achieved, grinding capability is improved, and thereby desired grinding can be achieved easily in a short period of time.

Figure 6:
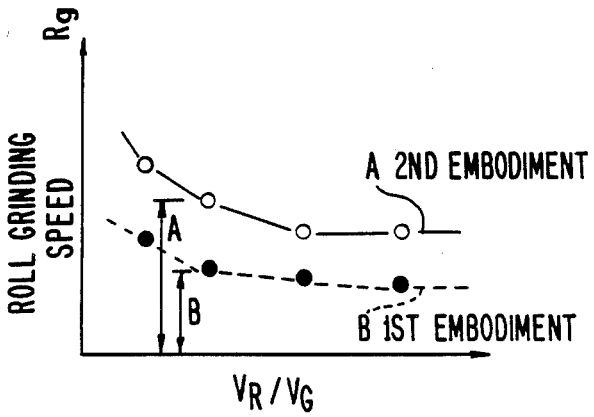
FIG. 6 is a diagram showing test results based on roll grinding speed.

Results of tests in which a grinding speed $R_g$ of a roll surface was investigated by effecting grinding of a roll by means of the rotary body grinding apparatus according to the second preferred embodiment of the present invention as described above, are shown in FIG. 6 in comparison with those in a case in which grinding was effected with the axes of the grindstones inclined in one direction only. In this figure, curve A represents the data in the case where the roll was ground with the adjacent grindstones (1*a*) and (1*b*) inclined at an angle $\theta$ in opposite directions to each other according to the just described second preferred embodiment of the present invention, whereas curve B represents the data in the case where a roll was ground with all the grindstones (1) inclined at an angle $\theta$ in the same direction according to the previously described first preferred embodiment. The grinding speed $R_g$ is defined as a depth of grinding per one revolution of a roll represented in $\mu$m/revolution. As will be seen from FIG. 6, regardless of the value of the circumferential velocity ratio $V_R/V_g$ of a roll to a grindstone, the grinding speed in the bi-directional grinding according to the second preferred embodiment is far higher than that in the unidirectional grinding. That is, it can be seen that upon practicing the present invention, the grinding capability of the second preferred embodiment provides better results than that of the first preferred embodiment.

As will be apparent from the above description, in the apparatus according to the present invention, regardless of whether either one of the first and second preferred embodiments is practiced, clogging will not occur on the grinding surface of the rotated grinding body because the grinding body is likewise rotated. In addition, since a rotary driving device for a grinding body is not necessitated, the structure of the grinding apparatus is very simple even including the feed device.

Especially, in the case of the second preferred embodiment, since a plurality of grinding bodies are arranged in such a manner that among the grinding bodies, adjacent ones are inclined in opposite directions to each other, the surface of a rotary body to be ground is ground in two directions, and so, the grinding capability is greatly enhanced. Accordingly, the present invention contributes greatly to improvement in an efficiency of the grinding operation as well as a reduction in installation costs.

While the present invention has been explained principally with respect to the case where the invention is applied to on-line grinding of a work roll in a rolling mill in the above description, the present invention should not be limited only to such an application, but it can be applied also to on-line grinding of a back roll in a rolling mill and other rolls such as, for instance, a pinch roll, a table roll, etc., and furthermore, generally to grinding of other rotary cylindrical bodies.

What is claimed is:

1. A method for grinding a rotary body, said method comprising:

positioning a grinding body having a grinding face and being freely rotation about a central axis thereof against the surface of the rotary body such that said grinding face contacts said rotary body, said central axis of said grinding body is disposed parallel to a plane passing through the axis of the rotary body, said central axis is skewed at a predetermined angle relative to the axis of the rotary body, and said face of said grinding body contacting said rotary body is located along a first line that is perpendicular to both said plane and said central axis of said grinding body;

rotating said rotary body thereby rotating said freely rotatable grinding body at a circumferential velocity different from that of said rotated rotary body as a result of said positioning of said freely grinding body against the surface of the rotary body such that said grinding body grinds said rotary body; and moving said freely rotatable grinding body relative to said rotary body in the direction in which the axis of said rotary body extends thereby grinding said rotary body along the length thereof over which said grinding body is moved.

2. A method as claimed in claim 1 and further comprising, positioning at least one other grinding body having a grinding face and being freely rotatable about a central axis thereof against said rotary body and such that said grinding face of said at least one other grinding body contacts said rotary body, said central axis of said least one other grinding body is disposed parallel to a plane passing through the axis of said rotary body and is skewed at said predetermined angle relative to the axis of the rotary body, and the face of said at least one other grinding body contacting said rotary body is located along a second line spaced from said first line along the axis of said rotary body, said second line being perpendicular to both said latter plane and said central axis of said grinding body, and central axes of adjacently spaced grinding bodies extend in opposite directions to one another with respect to the axis of said rotary body.

3. An apparatus for grinding a rotary body that is supported and driven to rotate about an axis thereof, said apparatus comprising:

at least one grinding body rotatably supported for freely rotating about a central axis thereof, said grinding body contacting the rotary body for grinding the rotary body, and said grinding body having said central axis disposed such that said central axis of said grinding body extends parallel to a plane passing through the axis of the rotary body and is skewed at a predetermined angle relative to the axis of the rotary body, and the face of said grinding body contacting the rotary body is located along a first line that is perpendicular to both said plane and said central axis of said grinding body; and grinding body support and feed means for supporting said at least one grinding body and for moving said at least one grinding body in a direction parallel to the direction in which the axis of the rotary body extends.

4. An apparatus as claimed in claim 3 wherein, said at least one grinding body comprises a plurality of grinding bodies spaced from one another along the axis of the rotary body, central axes of adjacently spaced ones of said plurality of grinding bodies extending in opposite directions to one another with respect to the axis of said rotary body.

* * * * *